US010023946B2

(12) United States Patent
Terazawa et al.

(10) Patent No.: US 10,023,946 B2
(45) **Date of Patent: *Jul. 17, 2018**

(54) THICK STEEL SHEET HAVING EXCELLENT CTOD PROPERTIES IN MULTILAYER WELDED JOINTS, AND MANUFACTURING METHOD FOR THICK STEEL SHEET

(71) Applicant: JFE STEEL CORPORATION, Tokyo (JP)

(72) Inventors: Yusuke Terazawa, Kawasaki (JP); Katsuyuki Ichimiya, Kurashiki (JP); Kazukuni Hase, Kurashiki (JP); Shigeru Endo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 403 days.

This patent is subject to a terminal disclaimer.

(21) Appl. No.: 14/774,366

(22) PCT Filed: Mar. 5, 2014

(86) PCT No.: PCT/JP2014/001218

§ 371 (c)(1),
(2) Date: Sep. 10, 2015

(87) PCT Pub. No.: WO2014/141632

PCT Pub. Date: Sep. 18, 2014

(65) Prior Publication Data

US 2016/0040274 A1 Feb. 11, 2016

(30) Foreign Application Priority Data

Mar. 12, 2013 (JP) ..... 2013-048819

(51) Int. Cl.

| | |
|---|---|
| ***C22C 38/00*** | (2006.01) |
| ***C22C 38/50*** | (2006.01) |
| ***C22C 38/14*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |
| ***C21D 6/00*** | (2006.01) |
| ***C21D 9/46*** | (2006.01) |

(52) U.S. Cl.

CPC ..... *C22C 38/50* (2013.01); *C21D 6/001* (2013.01); *C21D 6/002* (2013.01); *C21D 6/005* (2013.01); *C21D 6/008* (2013.01); *C21D 8/0226* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01)

(58) Field of Classification Search

CPC ..... C21D 9/46; C21D 6/001; C21D 6/002
See application file for complete search history.

(56) References Cited

U.S. PATENT DOCUMENTS

| | | | | |
|---|---|---|---|---|
| 8,361,249 | B2 * | 1/2013 | Shimoyama | C21D 8/02 148/320 |
| 8,647,564 | B2 * | 2/2014 | Ahn | C21D 6/005 148/320 |
| 2011/0041965 | A1 * | 2/2011 | Hoshino | C21D 8/02 148/645 |

(Continued)

FOREIGN PATENT DOCUMENTS

| | | |
|---|---|---|
| CN | 1380910 | 11/2002 |
| CN | 101578384 | 11/2009 |

(Continued)

OTHER PUBLICATIONS

International Search Report for International Application No. PCT/JP2014/001220 dated Jun. 10, 2014.

(Continued)

*Primary Examiner* — Scott R Kastler
(74) *Attorney, Agent, or Firm* — RatnerPrestia

(57) ABSTRACT

Provided are a thick steel plate with which a welded joint having good CTOD property is formed by low-to-medium heat input multipass welding and a method for producing the thick steel plate.

The steel plate has a composition containing, by mass, C: 0.03% to 0.10%, Si: 0.5% or less, Mn: 1.0% to 2.0%, P: 0.015% or less, S: 0.0005% to 0.0050%, Al: 0.005% to 0.060%, Ni: 0.5% to 2.0%, Ti: 0.005% to 0.030%, N: 0.0015% to 0.0065%, O: 0.0010% to 0.0050%, Ca: 0.0005% to 0.0060%, and, as needed, one or more elements such as Cu. Ti/N, Ceq, Pcm, and ACR each fall within the specific range. The effective crystal grain size of the base metal at the center of the plate in the thickness direction is 20 μm or less. A specific amount of a composite inclusion including a sulfide containing Ca and Mn and an oxide containing Al having an equivalent circular diameter of 0.1 μm or more is present at the ¼-thickness position and the ½-thickness position of the plate. The steel having the above-described composition is heated to a specific temperature, hot rolled, and cooled.

8 Claims, No Drawings

(56) References Cited

U.S. PATENT DOCUMENTS

| | | | |
|---|---|---|---|
| 2015/0075682 | A1 | 3/2015 | Yuga |
| 2016/0040274 | A1 | 2/2016 | Terazawa et al. |

FOREIGN PATENT DOCUMENTS

| | | | |
|---|---|---|---|
| CN | 102124133 | | 7/2011 |
| EP | 1262571 | | 12/2002 |
| EP | 2218800 | | 8/2010 |
| EP | 2272994 | | 1/2011 |
| EP | 2666880 | | 11/2013 |
| EP | 2813596 | | 12/2014 |
| JP | 60184663 | | 9/1985 |
| JP | 61253344 | | 11/1986 |
| JP | 0277521 | | 3/1990 |
| JP | 0353367 | | 8/1991 |
| JP | 05186823 | | 7/1993 |
| JP | 05271766 | | 10/1993 |
| JP | 07292414 | | 11/1995 |
| JP | 1017982 | | 1/1998 |
| JP | 11140582 | | 5/1999 |
| JP | 2002235114 | A | 8/2002 |
| JP | 2005068478 | | 3/2005 |
| JP | 2007254767 | | 10/2007 |
| JP | 2010202949 | | 9/2010 |
| JP | 2012162797 | | 8/2012 |
| JP | 2012184500 | | 9/2012 |
| JP | 2013023713 | | 2/2013 |
| JP | 2013095927 | | 5/2013 |
| JP | 2013095928 | | 5/2013 |
| KR | 20100116701 | A | 11/2010 |
| WO | 2009072753 | | 6/2009 |

OTHER PUBLICATIONS

Entire patent prosecution history of U.S Appl. No. 14/774,351, filed Sep. 10, 2015, entitled, "Thick Steel Sheet Having Excellent CTOD Properties in Multilayer Welded Joints, and Manufacturing Method for Thick Steel Sheet."

Chinese Office Action dated Apr. 20, 2016 for Application No. 201480014302.2, including Concise Statement of Relevance, 20 pages.

International Search Report for International Application No. PCT/JP2014/001218 dated Jun. 10, 2014.

Korean Office Action dated Jul. 19, 2016 for Korean Application No. 2015-7025141, including Concise Statement of Relevance, 16 pages.

Extended European Search Report dated Mar. 16, 2016 for European Application No. 14762492.8-1373.

Chinese Office Action for Chinese Application No. 201480014302.2, dated Jan. 4, 2017, including Concise Statement of Search Report, 9 pages.

Chinese Office Action with partial English language translation for Application No. 201480014302.2, dated Jul. 7, 2017, 7 pages.

Korean Office Action for Application No. 9-5-2017-002984311, dated Jan. 12, 2017, 5 pages.

Korean Final Rejection for Korean Application No. 10-2015-7027828, dated Mar. 31, 2017, with Concise Statement of Relevance of Office Action—4 Pages.

Non Final Office Action for U.S. Appl. No. 14/774,351, dated Dec. 20, 2017, 14 pages.

* cited by examiner

THICK STEEL SHEET HAVING EXCELLENT CTOD PROPERTIES IN MULTILAYER WELDED JOINTS, AND MANUFACTURING METHOD FOR THICK STEEL SHEET

CROSS REFERENCE TO RELATED APPLICATIONS

This is the U.S. National Phase application of PCT International Application No. PCT/JP2014/001218, filed Mar. 5, 2014, and claims priority to Japanese Patent Application No. 2013-048819, filed Mar. 12, 2013, the disclosures of each of these applications being incorporated herein by reference in their entireties for all purposes.

FIELD OF THE INVENTION

The present invention relates to steel materials used for constructing ships, offshore structures, line pipes, pressure vessels, and the like and specifically relates to a thick steel plate or sheet that has high low-temperature toughness as a base metal and also enables a welded joint having good CTOD property to be formed by low-to-medium heat input multipass welding and a method for producing the thick steel plate.

BACKGROUND OF THE INVENTION

While a Charpy test has been commonly used as a standard for evaluating the toughness of steel, recently, a crack tip opening displacement test (hereinafter, referred to as "CTOD testing") has become increasingly used for evaluating, with higher accuracy, the fracture resistance of a thick steel plate used for constructing structures. In CTOD testing, a test specimen having a fatigue crack formed in a toughness-evaluation portion of the test specimen is subjected to a bending test at a low temperature and an opening displacement (i.e., amount of plastic deformation) at the crack tip which occurs immediately before fracture is measured in order to evaluate resistance to brittle fracture.

When a structure is constructed using a thick steel plate, multipass welding is employed. It is known that a heat affected zone formed by multipass welding (hereinafter, referred to as "multipass weld HAZ") includes a zone having considerably low toughness (hereinafter, referred to as "inter critically reheated coarse grain heat affected zone (ICCGHAZ)"), which includes a coarse base microstructure and an island-like martensite (i.e., martensite-austenite constituent (MA)) microstructure mixed in the coarse base microstructure. The ICCGHAZ is formed by reheating a zone in which a coarse microstructure is formed in the vicinity of the weld line by the preceding weld pass (i.e., coarse grain heat affected zone (CGHAZ)) to the ferrite-austenite dual phase region in the weld pass for the following layer.

In general, CTOD testing of welded joints examines a steel plate over its entire thickness. Therefore, when the multipass weld HAZ is examined, an evaluation zone in which the fatigue crack is to be formed includes the ICCGHAZ microstructure. The CTOD property of welded joints measured by CTOD testing of welded joints is affected by the toughness of a zone that has become the most brittle among the evaluation zone even the area of such a zone is small. Consequently, not only the toughness of the CGHAZ microstructure but also the toughness of the ICCGHAZ microstructure affects the CTOD property of welded joints in the multipass weld HAZ. Thus, in order to enhance the CTOD property of welded joints in the multipass weld HAZ, an increase in the toughness of the ICCGHAZ microstructure is also required.

In order to increase the heat-affected-zone (also referred to as "HAZ") toughness, a technique in which coarsening of the austenite grains in the CGHAZ is prevented from occurring by dispersing TiN in the form of fine particles and a technique in which the TiN particles are used as nuclei for ferrite transformation have been used.

In addition, a technique in which the growth of the austenite grains is limited by dispersing a REM-based oxysulfide, which is produced by addition of a REM; a technique in which the growth of the austenite grains is limited by dispersing a Ca-based oxysulfide, which is produced by addition of Ca; and a technique in which the ferrite-nucleation-capability of BN and dispersion of an oxide are used in combination have also been used.

For example, Patent Literature 1 and Patent Literature 2 propose a technique in which coarsening of the austenite microstructure in the HAZ is prevented from occurring by using REM and TiN particles. Patent Literature 3 proposes a technique in which CaS is used for increasing the HAZ toughness and a technique in which hot rolling is performed for increasing the toughness of the base metal.

There has also been proposed a technique (e.g., Patent Literature 4) in which, in order to address the reduction in the ICCGHAZ toughness, formation of MA is limited by reducing the C and Si contents and the strength of the base metal is increased by adding Cu. Patent Literature 5 proposes a technique in which the grain refinement of the HAZ microstructure is achieved by using BN particles as nuclei for ferrite transformation in the large-heat-input heat affected zone in order to increase the HAZ toughness.

PATENT LITERATURE

Patent Literature 1: Japanese Examined Patent Application Publication No. 03-053367

Patent Literature 2: Japanese Unexamined Patent Application Publication No. 60-184663

Patent Literature 3: Japanese Unexamined Patent Application Publication No. 2012-184500

Patent Literature 4: Japanese Unexamined Patent Application Publication No. 05-186823

Patent Literature 5: Japanese Unexamined Patent Application Publication No. 61-253344

SUMMARY OF THE INVENTION

However, the CTOD specification temperature described in standards (e.g., API Standard RP-2Z) stipulating the CTOD property of welded joints is generally −10° C. In order to acquire new resources with a recent increase in energy demand, regions in which offshore structures and the like are built are being shifted to cold regions, in which resource mining has not been done before. Accordingly, there has been growing demand for steel materials that can be used at a CTOD specification temperature lower than the CTOD specification temperature stipulated by the API standard (hereinafter, also referred to as "special low-temperature CTOD specification"). It was found from the studies conducted by the inventors of the present invention that it is impossible to fully satisfy such a CTOD property of welded joints which is required by multipass welded joints for low-temperature specification that have been increasingly demanded by using the above-described techniques. For example, in the techniques described in Patent Literature 1 and Patent Literature 2, in which coarsening of the austenite microstructure in the HAZ is prevented from occurring by using REM and TiN particles, the TiN particles may be melted at the weld junction, which is heated to a high temperature during welding, and consequently the growth of the austenite grains may fail to be limited to a sufficient degree.

Although the REM-based oxysulfide and Ca-based oxysulfide are effective for limiting the growth of the austenite grains, it is impossible to satisfy the CTOD property of welded joints at the above-described low-temperature specification temperature only by increasing the toughness by preventing coarsening of the austenite grains in the HAZ from occurring. The ferrite-nucleus-forming capability of BN is effective when the welding heat input is large, the cooling rate of a heat affected zone is low, and the HAZ microstructure is mainly composed of ferrite. However, the above-described advantageous effect is not achieved in welding of a thick steel plate because the content of alloy constituents in the base metal is relatively high, the heat input during multipass welding is relatively low, and consequently the HAZ microstructure is mainly composed of bainite.

In Patent Literature 3, although the CTOD property of welded joints is satisfied at the normal specification temperature (−10° C.), the CTOD property of welded joints at the above-described low-temperature specification temperature has not been examined.

The CTOD property of welded joints at the above-described low-temperature specification temperature is not examined also in Patent Literature 4. It is considered that it is impossible to satisfy the special low-temperature CTOD specification only by increasing the ICCGHAZ toughness by reducing the composition of the base metal. In addition, reducing the content of the alloy elements in the composition of the base metal in order to increase the ICCGHAZ toughness may deteriorate the properties of the base metal. Therefore, it is difficult to apply this technique to a thick steel plate used for constructing offshore structures and the like.

The technique described in Patent Literature 5 is effective when the cooling rate of the heat affected zone is low as in large-heat-input welding and the HAZ microstructure is mainly composed of ferrite. However, the above-described advantageous effect is not achieved in welding of a thick steel plate because the content of alloy constituents in the base metal is relatively high, the heat input during multipass welding is relatively low, and consequently the HAZ microstructure is mainly composed of bainite.

As described above, it is hard to say that a technique for increasing the CGHAZ toughness and the ICCGHAZ toughness in a multipass heat affected zone of a thick steel plate has been established. It has been difficult to enhance the CTOD property of welded joints having a notch formed in a weld junction in which the CGHAZ and the ICCGHAZ coexist.

Accordingly, an object of the present invention is to provide a thick steel plate with which a multipass welded joint having good CTOD property is formed and a method for producing the thick steel plate.

In order to address the above-described issues, the inventors of the present invention have focused attention on a Ca-based composite inclusion, conducted extensive studies of the prevention of coarsening of the austenite grains in the multipass weld HAZ, nucleation for bainite, acicular ferrite, and ferrite, and an increase in the toughness of the multipass weld HAZ, and, as a result, found the following facts.

(1) When the Ca, O, and S contents in a steel are controlled such that an atomic concentration ratio (ACR) represented by the following expression is 0.2 to 1.4, the form of a sulfide is changed to a composite inclusion including a Ca-based sulfide in which Mn is partially dissolved and an Al-based oxide.

$$ACR=(Ca-(0.18+130\times Ca)\times O)/(1.25\times S)$$

(2) Changing the form of the inclusion to a composite inclusion including a sulfide containing Ca and Mn and an oxide containing Al enables the inclusion to be consistently present even in a zone in the vicinity of the weld line which is heated to a high temperature. This enables the size of the austenite grains to be decreased to a sufficient degree. Furthermore, a Mn-poor layer is formed in the periphery of the composite inclusion, which enables nucleation for bainite and acicular ferrite to occur.

(3) Nucleation sites are formed in the HAZ during cooling primarily at the austenite grain boundaries. In embodiments of the present invention, since the above-described composite inclusion, which causes nucleation to occur, is present inside the austenite grains, nucleation is originated from not only the austenite grain boundaries but also the inside of the austenite grains. This enables a fine HAZ microstructure to be finally produced, which increases the HAZ toughness and the CTOD property of welded joints.

(4) Nucleation for bainite, acicular ferrite, and ferrite which is caused by the above-described composite inclusion does not occur to a sufficient degree when the size of the inclusion is excessively small. The size of the inclusion needs to be 0.1 μm or more in terms of equivalent circular diameter.

(5) In order to fully utilize the particles of the above-described composite inclusion as nuclei for transformation, one or more particles of the inclusion need to be included in the austenite grains in the HAZ during weld heating. When the amount of heat input is set to about 5 kJ/mm, the diameter of the austenite grains in the vicinity of the weld line becomes about 200 μm. Thus, the density of the inclusion needs to be 25 particle/$mm^2$ or more.

(6) Since the toughness of the above-described composite inclusion is low, an excessive content of inclusion may reduce the HAZ toughness. In particular, when an unsolidified component in the slab is caused to suspend due to a difference in density between the inclusion and the steel in the production of a slab by continuous casting, the inclusion is likely to accumulate at the ¼-t (t: thickness of the plate) position. Therefore, it is necessary to control the number of the particles of the inclusion not to be excessive. It is also necessary to control the number of the particles of the inclusion to be appropriate in the center of the plate in the thickness direction, in which the toughness of the multipass weld HAZ is poor due to the presence of segregated elements. Controlling the numbers of the particles of the inclusion to 250 particle/$mm^2$ or less enables good CTOD property of multipass welded joints to be achieved.

(7) In general, a coarse inclusion may be dispersed at a low density in an element-segregated portion at the center of the slab in the thickness direction due to concentration of alloy elements. However, applying a large rolling reduction per pass, that is, specifically, performing rolling reduction such that the cumulative rolling reduction ratio of passes performed at a rolling reduction ratio per pass of 8% or more while the temperature of the center of the plate in the thickness direction is 950° C. or more is 30% or more, or performing rolling reduction such that the cumulative rolling reduction ratio of passes performed at a rolling reduction ratio per pass of 5% or more while the temperature of the center of the plate in the thickness direction is 950° C. or more is 35% or more, causes the strain applied at the center of the plate in the thickness direction to be increased, which causes the coarse inclusion to be elongated and thereby divided. This enables a fine inclusion to be dispersed at a high density, which enables the HAZ toughness to be increased due to the inclusion and good CTOD property capable of addressing the special CTOD specification to be achieved.

In addition to the refinement of the multipass weld HAZ due to the control of the form of the inclusion, controlling Ti/N to be $1.5 \leq Ti/N \leq 5.0$ in order to disperse TiN, which limits the growth of the austenite grains in an effective manner, in a steel in the form of fine particles, a carbon equivalent Ceq=[C]+[Mn]/6+([Cu]+[Ni])/15+([Cr]+[Mo]+[V])/5 to be less than 0.45, and a weld cracking parameter Pcm=[C]+[Si]/30+([Mn]+[Cu]+[Cr])/20+[Ni]/60+[Mo]/15+[V]/10+5[B] to be less than 0.20 enable the toughness of the base microstructure of the multipass weld HAZ to be increased.

The inventors of the present invention have also studied the property of the SC/ICHAZ (subcritically reheated HAZ/intercritically reheated HAZ) boundary, which is the boundary between the transformed region and the untransformed region of the base metal during welding, which are required by BS Standard EN10225 (2009) and API Standard Recommended Practice 2Z (2005) that specify a method for CTOD testing of welded joints. As a result, the inventors have found that the CTOD property of welded joints at the SC/ICHAZ boundary is primarily affected by the toughness of the base metal and therefore, in order to achieve the CTOD property of welded joints at the SC/ICHAZ boundary at a testing temperature of −40° C., it is necessary to increase the toughness of the base metal by reducing the effective crystal grain size of the microstructure of the base metal to 20 μm or less, that is, refinement of crystal grains. The expression "good CTOD property of multipass welded joints" used herein means that both crack tip opening displacement measured when a notch is formed in the weld junction and crack tip opening displacement measured when a notch is formed in the SC/ICHAZ are 0.4 mm or more at a testing temperature of −40° C.

Further studies have been conducted on the basis of the above-described facts, and the present invention was made. Specifically, the present invention includes:

1. A thick steel plate with which a multipass welded joint having good CTOD property is formed, the thick steel plate having a composition containing, by mass, C: 0.03% to 0.10%, Si: 0.5% or less, Mn: 1.0% to 2.0%, P: 0.015% or less, S: 0.0005% to 0.0050%, Al: 0.005% to 0.060%, Ni: 0.5% to 2.0%, Ti: 0.005% to 0.030%, N: 0.0015% to 0.0065%, O: 0.0010% to 0.0050%, and Ca: 0.0005% to 0.0060%, with the balance being Fe and inevitable impurities. The composition satisfies Expressions (1) to (4) below. The effective crystal grain size of the base metal at the center of the plate in the thickness direction is 20 μm or less. The densities of a composite inclusion at the ¼-thickness position and the ½-thickness position (t: mm) of the plate, the composite inclusion including a sulfide containing Ca and Mn and an oxide containing Al, the composite inclusion having the equivalent circular diameter of 0.1 μm or more, are each 25 to 250 particle/mm$^2$.

$$1.5 \leq Ti/N \leq 5.0 \quad (1)$$

$$Ceq(=[C]+[Mn]/6+([Cu]+[Ni])/15+([Cr]+[Mo][V])/5) \leq 0.45 \quad (2)$$

$$Pcm(=[C]+[Si]/30+([Mn]+[Cu]+[Cr])/20+[Ni]/60+[Mo]/15+[V]/10+5[B]) \leq 0.20 \quad (3)$$

$$0.2 < (Ca-(0.18+130 \times Ca) \times O)/(1.25 \times S) < 1.4 \quad (4)$$

In Expressions (1) to (4), alloy element symbols represent the contents (mass %) of the respective elements.

2. The thick steel plate described in 1, with which a multipass welded joint having good CTOD property is formed, the composition of the thick steel plate further containing one or more elements selected from, by mass, Cu: 0.05% to 2.0%, Cr: 0.05% to 0.30%, Mo: 0.05% to 0.30%, Nb: 0.005% to 0.035%, V: 0.01% to 0.10%, W: 0.01% to 0.50%, B: 0.0005% to 0.0020%, REM: 0.0020% to 0.0200%, and Mg: 0.0002% to 0.0060%.

3. A method for producing the thick steel plate described in 1 or 2, with which a multipass welded joint having good CTOD property is formed, the method including: heating a steel slab having the composition described in 1 or 2 to 950° C. or more and 1200° C. or less; performing hot rolling such that the cumulative rolling reduction ratio of passes performed at a rolling reduction ratio per pass of 8% or more while the temperature of the center of the plate in the thickness direction is 950° C. or more is 30% or more, and performing hot rolling such that a cumulative rolling reduction ratio of passes performed while the temperature of the center of the plate in the thickness direction is less than 950° C. is 40% or more; and performing cooling to 600° C. or less such that the average cooling rate between 700° C. and 500° C. at the center of the plate in the thickness direction is 1° C./sec to 50° C./sec.

4. A method for producing the thick steel plate described in 1 or 2, with which a multipass welded joint having good CTOD property is formed, the method including: heating a steel slab having the composition described in 1 or 2 to 950° C. or more and 1200° C. or less; performing hot rolling such that the cumulative rolling reduction ratio of passes performed at a rolling reduction ratio per pass of 5% or more while the temperature of the center of the plate in the thickness direction is 950° C. or more is 35% or more, and performing hot rolling such that a cumulative rolling reduction ratio of passes performed while the temperature of the center of the plate in the thickness direction is less than 950° C. is 40% or more; and performing cooling to 600° C. or less such that the average cooling rate between 700° C. and 500° C. at the center of the plate in the thickness direction is 1° C./sec to 50° C./sec.

5. The method described in 3 or 4 for producing the thick steel plate with which a multipass welded joint having good CTOD property is formed, the method further including performing a tempering treatment at 700° C. or less subsequent to cooling.

According to the present invention, a thick steel plate with which a multipass welded joint having good CTOD property is formed and a method for producing the thick steel plate can be provided, which is markedly advantageous from an industrial viewpoint.

DETAILED DESCRIPTION OF EMBODIMENTS OF THE INVENTION

Reasons for limiting the components of embodiments of the present invention are described below.

1. Chemical Composition

Reasons for specifying the preferred chemical composition of a steel used in the present invention are described below. Hereinafter, "%" always denotes "% by mass".

C: 0.03% to 0.10%

Carbon (C) is an element that increases the strength of a steel. Thus, the C content needs to be 0.03% or more. However, an excessive C content, that is, specifically, a C content exceeding 0.10%, may reduce the CTOD property of welded joints. Accordingly, the C content is limited to 0.03% to 0.10% and is preferably set to 0.04% to 0.08%.

Si: 0.5% or Less

An excessive silicon (Si) content, that is, specifically, a Si content exceeding 0.5%, may deteriorate the CTOD property of welded joints. Accordingly, the Si content is limited to 0.5% or less, is preferably set to 0.4% or less, and is further preferably set to more than 0.1% and 0.3% or less.

Mn: 1.0% to 2.0%

Manganese (Mn) is an element that enhances the hardenability of a steel and thereby increases the strength of the steel. However, an excessive Mn content may significantly deteriorate the CTOD property of welded joints. Accordingly, the Mn content is limited to 1.0% to 2.0% and is preferably set to 1.2% to 1.8%.

P: 0.015% or Less

Phosphorus (P), which is an element inevitably included in a steel as an impurity, may reduce the toughness of a steel. Thus, it is desirable to set the P content as low as possible. In particular, a P content exceeding 0.015% may significantly deteriorate the CTOD property of welded joints. Accordingly, the P content is limited to 0.015% or less and is preferably set to 0.010% or less.

S: 0.0005% to 0.0050%

Sulfur (S) is an element that is necessary to form an inclusion that increases the toughness of the multipass weld HAZ. Thus, the S content needs to be 0.0005% or more. However, a S content exceeding 0.0050% may deteriorate the CTOD property of welded joints. Accordingly, the S content is limited to 0.0050% or less and is preferably set to 0.0045% or less.

Al: 0.005% to 0.060%

Aluminium (Al) is an element that is necessary to form an inclusion that increases the toughness of the multipass weld HAZ. Thus, the Al content needs to be 0.005% or more. However, an Al content exceeding 0.060% may deteriorate the CTOD property of welded joints. Accordingly, the Al content is limited to 0.060% or less.

Ni: 0.5% to 2.0%

Nickel (Ni) is an element capable of increasing strength without significantly reducing the toughness of the base metal nor the toughness of welded joints. In order to achieve this effect, the Ni content needs to be 0.5% or more. However, if the Ni content exceeds 2.0%, the increase in strength may be saturated and an increase in the cost may become an issue. Accordingly, the upper limit for the Ni content is set to 2.0%. The Ni content is preferably set to 0.5% to 1.8%.

Ti: 0.005% to 0.030%

Titanium (Ti), which precipitates as TiN, is an element that prevents coarsening of the austenite grains in the HAZ from occurring, thereby enables the refinement of the HAZ microstructure to be achieved, and consequently increases toughness in an effective manner. In order to achieve this effect, the Ti content needs to be 0.005% or more. However, an excessive Ti content, that is, specifically, a Ti content exceeding 0.030%, may cause dissolved Ti and coarse TiC particles to be precipitated, which reduces the toughness of the heat affected zone. Accordingly, the Ti content is limited to 0.005% to 0.030% and is preferably set to 0.005% to 0.025%.

N: 0.0015% to 0.0065%

Nitrogen (N), which precipitates as TiN, is an element that prevents coarsening of the austenite grains in the HAZ from occurring, thereby enables the refinement of the HAZ microstructure to be achieved, and consequently increases toughness in an effective manner. In order to achieve this effect, the N content needs to be 0.0015% or more. However, an excessive N content, that is, specifically, a N content exceeding 0.0065%, may reduce the toughness of the heat affected zone. Accordingly, the N content is limited to 0.0015% to 0.0065% and is preferably set to 0.0015% to 0.0055%.

O: 0.0010% to 0.0050%

Oxygen (O) is an element that is necessary to form an inclusion that increases the toughness of the multipass weld HAZ. Thus, the O content needs to be 0.0010% or more. However, an O content exceeding 0.0050% may deteriorate the CTOD property of welded joints. Accordingly, in an embodiment of the present invention, the O content is limited to 0.0010% to 0.0050% and is preferably set to 0.0010% to 0.0045%.

Ca: 0.0005% to 0.0060%

Calcium (Ca) is an element that is necessary to form an inclusion that increases the toughness of the multipass weld HAZ. Thus, the Ca content needs to be 0.0005% or more. However, a Ca content exceeding 0.0060% may deteriorate the CTOD property of welded joints. Accordingly, in an embodiment of the present invention, the Ca content is limited to 0.0005% to 0.0060% and is preferably set to 0.0007% to 0.0050%.

$$1.5 \leq Ti/N \leq 5.0 \quad (1)$$

Ti/N controls the amount of N dissolved in the HAZ and the state of the precipitated TiC particles. If Ti/N is less than 1.5, the presence of the dissolved N, which is not fixed as TiN, may reduce the HAZ toughness. On the other hand, if Ti/N is more than 5.0, coarse TiC particles may be precipitated, which reduces the HAZ toughness. Accordingly, Ti/N is limited to 1.5 or more and 5.0 or less and is preferably set to 1.8 or more and 4.5 or less. In Expression (1) above, alloy element symbols represent the contents (mass %) of the respective elements.

Ceq: 0.45% or Less

An increase in Ceq results in an increase in the content of microstructures having low toughness, such as island-like martensite and bainite, in the HAZ microstructure, which reduces the HAZ toughness. If Ceq is more than 0.45%, the toughness of the base microstructure of the HAZ may be reduced, which makes it impossible to satisfy the required CTOD property of welded joints even when the inclusion is used for increasing the HAZ toughness. Accordingly, the upper limit for Ceq is set to 0.45%. Ceq is represented by the following expression: $Ceq=[C]+[Mn]/6+([Cu]+[Ni])/15+([Cr]+[Mo]+[V])/5$ . . . (2), where alloy element symbols represent the contents (mass %) of the respective elements.

Pcm: 0.20% or Less

An increase in Pcm results in an increase in the content of microstructures having low toughness, such as island-like martensite and bainite, in the HAZ microstructure, which reduces the HAZ toughness. If Pcm is more than 0.20%, the toughness of the base microstructure of the HAZ may be reduced, which makes it impossible to satisfy the required CTOD property of welded joints even when the inclusion is used for increasing the HAZ toughness. Accordingly, the upper limit for Pcm is set to 0.20%. Pcm is represented by the following expression: $Pcm=[C]+[Si]/30+([Mn]+[Cu]+$

[Cr])/20+[Ni]/60+[Mo]/15+[V]/10+5[B] . . . (3), where alloy element symbols represent the contents (mass %) of the respective elements.

$$0.2 \leq (Ca-(0.18+130\times Ca)\times O)/(1.25\times S) \leq 1.4 \quad (4)$$

The atomic concentration ratio (ACR) of Ca, O, and S included in a steel is represented by (Ca−(0.18+130×Ca)×O)/(1.25×S). If (Ca−(0.18+130×Ca)×O)/(1.25×S) is less than 0.2, the sulfide-based inclusion primarily takes the form of MnS. Since MnS, which has a low melting point, is melted in the vicinity of the weld line during welding, the prevention of coarsening of the austenite grains in the vicinity of the weld line and nucleation for transformation during cooling subsequent to welding cannot be achieved. On the other hand, if (Ca−(0.18+130×Ca)×O)/(1.25×S) exceeds 1.4, the sulfide-based inclusion primarily takes the form of CaS. In such a case, nucleation for transformation does not occur because the Mn-poor layer, which is necessary to form the nuclei for transformation, is not formed in the peripheries of the CaS particles. Accordingly, (Ca−(0.18+130×Ca)×O)/(1.25×S) is limited to 0.2 or more and 1.4 or less and is preferably set to 0.3 or more and 1.2 or less. In Expression (4), alloy element symbols represent the contents (mass %) of the respective elements.

The thick steel plate according to embodiments of the present invention has the above-described composition as a fundamental composition with the balance being Fe and inevitable impurities. In order to control strength and toughness and increase the toughness of welded joints, the thick steel plate according to the present invention may further include one or more elements selected from Cu: 0.05% to 2.0%, Cr: 0.05% to 0.30%, Mo: 0.05% to 0.30%, Nb: 0.005% to 0.035%, V: 0.01% to 0.10%, W: 0.01% to 0.50%, B: 0.0005% to 0.0020%, REM: 0.0020% to 0.0200%, and Mg: 0.0002% to 0.0060%.

Cu: 0.05% to 2.0%

Copper (Cu) is an element capable of increasing strength without significantly reducing the toughness of the base metal nor the toughness of welded joints. The Cu content required for achieving the effect is 0.05% or more. However, if the Cu content is 2.0% or more, cracking may occur in a steel plate due to a Cu-concentrated layer formed immediately below scale. Accordingly, when Cu is added to a steel, the Cu content is limited to 0.05% to 2.0% and is preferably set to 0.1% to 1.5%.

Cr: 0.05% to 0.30%

Although chromium (Cr) is an element that enhances the hardenability of a steel and thereby increases the strength of the steel, an excessive Cr content may deteriorate the CTOD property of welded joints. Accordingly, when Cr is added to a steel, the Cr content is limited to 0.05% to 0.30%.

Mo: 0.05% to 0.30%

Although molybdenum (Mo) is an element that enhances the hardenability of a steel and thereby increases the strength of the steel, an excessive Mo content may deteriorate the CTOD property of welded joints. Accordingly, when Mo is added to a steel, the Mo content is limited to 0.05% to 0.30%.

Nb: 0.005% to 0.035%

Niobium (Nb) is an element that widens the non-crystallization temperature range of the austenite phase and thereby enables rolling to be efficiently performed in the non-crystallization range in order to form a fine microstructure in an effective manner. The Nb content required for achieving the effect is 0.005% or more. However, a Nb content exceeding 0.035% may deteriorate the CTOD property of welded joints. Accordingly, when Nb is added to a steel, the Nb content is limited to 0.005% to 0.035%.

V: 0.01% to 0.10%

Vanadium (V) is an element that increases the strength of the base metal. This effect occurs when the V content is 0.01% or more. However, a V content exceeding 0.10% may reduce the HAZ toughness. Accordingly, when V is added to a steel, the V content is limited to 0.01% to 0.10% and is preferably set to 0.02% to 0.05%.

W: 0.01% to 0.50%

Tungsten (W) is an element that increases the strength of the base metal. This effect occurs when the W content is 0.01% or more. However, a W content exceeding 0.50% may reduce the HAZ toughness. Accordingly, when W is added to a steel, the W content is limited to 0.01% to 0.50% and is preferably set to 0.05% to 0.35%.

B: 0.0005% to 0.0020%

Boron (B) is an element that enhances the hardenability of a steel even when the B content in the steel is low and thereby increase the strength of a steel plate in an effective manner. The B content required for achieving this effect is 0.0005% or more. However, a B content exceeding 0.0020% may reduce the HAZ toughness. Accordingly, when B is added to a steel, the B content is limited to 0.0005% to 0.0020%.

REM: 0.0020% to 0.0200%

A rare earth metal (REM) forms an oxysulfide-based inclusion, thereby limits the growth of the austenite grains in the HAZ, and consequently increases the HAZ toughness. The REM content required for achieving this effect is 0.0020% or more. However, an excessive REM content, that is, specifically, a REM content exceeding 0.0200%, may reduce the toughness of the base metal and HAZ toughness. Accordingly, when a REM is added to a steel, the REM content is limited to 0.0020% to 0.0200%.

Mg: 0.0002% to 0.0060%

Magnesium (Mg) is an element that forms an oxide-based inclusion, thereby limits the growth of the austenite grains in the heat affected zone, and consequently increases the toughness of the heat affected zone in an effective manner. The Mg content required for achieving this effect is 0.0002% or more. However, a Mg content exceeding 0.0060% is disadvantageous from an economic viewpoint because, if the Mg content exceeds 0.0060%, the effect may become saturated and an effect appropriate to the high Mg content cannot be expected. Accordingly, when Mg is added to a steel, the Mg content is limited to 0.0002% to 0.0060%.

2. Microstructure of Base Metal

In order to enhance the CTOD property of welded joints at the SC/ICHAZ boundary, the toughness of the base metal is increased by refining of the crystal grains at the center of the plate in the thickness direction, at which center segregation is likely to occur. Thus, the effective crystal grain size of the microstructure of the base metal at the center of the plate in the thickness direction is limited to 20 μm or less. The phase of the microstructure of the base metal is not particularly limited as long as it enables the desired strength to be achieved. The term "effective crystal grain size" used herein refers to the equivalent circular diameter of a crystal grain surrounded by high-angle boundaries at which a difference in the orientations of the adjacent crystal grains is 15° or more.

3. Inclusion

Composite Inclusion Including Sulfide Containing Ca and Mn and Oxide Containing Al: 0.1 μm or More in Terms of Equivalent Circular Diameter, 25 to 250 Particle/$Mm^2$ The particles of the inclusion serve as nuclei for transformation because, when a sulfide containing Mn is formed, a Mn-poor region is formed in the peripheries of the particles of the inclusion. Since the sulfide further contains Ca, the melting point of the inclusion becomes high and the inclusion remains even in the vicinity of the weld line in the HAZ which is heated to a high temperature. Thus, the particles of the inclusion limit the growth of the austenite grains and serve as nuclei for transformation. In order to achieve the above-described effects, the size of the particles of the composite inclusion is limited to 0.1 μm or more in terms of equivalent circular diameter, and the densities of the composite inclusion at the ¼-thickness position and the ½-thickness position are each limited to 25 to 250 particle/$mm^2$ and are each preferably set to 35 to 170 particle/$mm^2$.

4. Production Method

Reasons for limiting the conditions of the production method are described below. Hereinafter, a temperature refers to the temperature measured at the surface of a steel material unless otherwise specified.

Conditions for Heating Steel Slab

A steel slab is produced by continuous casting, in which the steel slab is heated to 950° C. or more and 1200° C. or less. If the heating temperature is lower than 950° C., an untransformed region may remain during heating and a coarse microstructure formed during solidification may remain, which makes it impossible to form a desired fine-grained microstructure. On the other hand, if the heating temperature is higher than 1200° C., coarse austenite grains may be formed, which makes it impossible to form a desired fine-grained microstructure by controlled rolling. Accordingly, the heating temperature is limited to 950° C. or more and 1200° C. or less and is preferably set to 970° C. or more and 1170° C. or less.

Hot Rolling Conditions

In hot rolling, pass conditions in the recrystallization temperature range and the pass conditions in the non-recrystallization temperature range are specified. In the recrystallization temperature range, hot rolling is performed such that the cumulative rolling reduction ratio of passes performed at a rolling reduction ratio per pass of 8% or more while the temperature of the center of the plate in the thickness direction is 950° C. or more is 30% or more. In the recrystallization temperature range, alternatively, hot rolling may be performed such that the cumulative rolling reduction ratio of passes performed at a rolling reduction ratio per pass of 5% or more while the temperature of the center of the plate in the thickness direction is 950° C. or more is 35% or more.

The rolling temperature is limited to 950° C. or more because rolling at a temperature of less than 950° C. is less likely to cause recrystallization to occur, which results in the failure to refine the austenite grains.

Rolling reduction performed at a rolling reduction ratio per pass of less than 8% does not cause the refinement of the crystal grains due to recrystallization to occur. Even when rolling reduction is performed at a rolling reduction ratio per pass of 8% or more, the refinement of the crystal grains due to recrystallization may become insufficient if the cumulative rolling reduction is 30% or less. Accordingly, the cumulative rolling reduction ratio of passed performed at a rolling reduction ratio per pass of 8% or more is limited to 30% or more. The inventors of the present invention have conducted further studies and found that, even if rolling reduction is performed at a rolling reduction ratio per pass of 5% or more, the refinement of the crystal grains due to recrystallization may be performed to a sufficient degree when the cumulative rolling reduction is set to 35% or more. Accordingly, when rolling reduction, is performed at a rolling reduction ratio per pass of 5% or more, the cumulative rolling reduction ratio is set to 35% or more.

In Non-Recrystallization Temperature Range, Cumulative Rolling Reduction Ratio of Passes Performed While Temperature of Center of Plate in Thickness Direction Is Less Than 950° C. Is Limited to 40% or More In the steel used in the present invention, recrystallization is less likely to occur if rolling reduction is performed at less than 950° C. The introduced strain is not consumed by recrystallization but is accumulated and serves as nuclei for transformation in the subsequent cooling step, which enables the refinement of the final microstructure to be achieved. The refinement of the crystal grains may fail to be performed to a sufficient degree if the cumulative rolling reduction ratio is less than 40%. Accordingly, the cumulative rolling reduction ratio of passes performed while the temperature of the center of the plate in the thickness direction is less than 950° C. is limited to 40% or more.

Cooling Conditions

Cooling is performed subsequent to hot rolling such that the average cooling rate between 700° C. and 500° C. at the center of the plate in the thickness direction is 1° C./sec to 50° C./sec. The cooling finishing temperature is set to 600° C. or less.

If the average cooling rate at the center of the plate in the thickness direction is less than 1° C./sec, a coarse ferrite phase may be formed in the microstructure of the base metal, which deteriorates the CTOD property of SC/ICHAZ. On the other hand, if the average cooling rate exceeds 50° C./sec, the strength of the base metal may be increased, which deteriorates the CTOD property of SC/ICHAZ. Accordingly, the average cooling rate between 700° C. and 500° C. at the center of the plate in the thickness direction is limited to 1° C./sec to 50° C./sec. If the cooling finishing temperature exceeds 600° C., the degree of transformation strengthening due to cooling may become insufficient, and consequently the strength of the base metal may become low. Accordingly, the cooling finishing temperature is limited to 600° C. or less.

After cooling is finished, tempering may be performed at 700° C. or less in order to reduce the strength of the base metal and increase toughness. If the tempering temperature is higher than 700° C., a coarse ferrite phase may be formed, which reduces the SCHAZ toughness. Accordingly, the tempering temperature is limited to 700° C. or less and is preferably set to 650° C. or less.

EXAMPLES

Table 1 summarizes the compositions of the steels to be tested, which were steel slabs produced by continuous casting using a continuous casting machine including a vertical portion having a length of 17 m. The casting rate was set to 0.2 to 0.4 m/min. The water volume density in the cooling zone was set to 1000 to 2000 l/min.·$m^2$. Steel Types A to K are Invention Examples having a composition that falls within the preferred scope of the present invention. Steel Types L to T are Comparative Examples having a composition that is out of the preferred range of the present invention. Thick steel plates were each prepared using a specific one of the steel types under the production conditions shown in Table 2. A multipass welded joint was formed in each of the thick steel plates. In hot rolling, a thermocouple was attached at the center of each plate in the longitudinal direction, the width direction, and the thickness direction in order to measure the temperature at the center of the plate in the thickness direction.

For each thick steel plate, the average effective crystal grain size of the microstructure of the base metal and the distribution of an inclusion in the plate-thickness direction were examined. Average effective crystal grain size was measured in the following manner. A sample was taken at the center of the plate in the longitudinal direction, the width direction, and the thickness direction. After being finished by mirror polishing, the sample was subjected to an EBSP analysis under the following conditions. Then, the equivalent circular diameter of a microstructure surrounded by high-angle boundaries at which a difference in the orientations of the adjacent crystal grains was 15° or more was determined from the resulting crystal-orientation map as an effective crystal grain size.

EBSP Conditions

Analysis region: 1 mm×1 mm region at the center of the plate in the thickness direction Step size: 0.4 μm The density of an inclusion was measured in the following manner. Samples were taken at the ¼-thickness position and the ½-thickness position in the longitudinal direction, the width direction, and the thickness direction and subjected to mirror polishing with a diamond buff and alcohol. An inclusion that was present in the 1 mm×1 mm evaluation region was identified by an EDX analysis using a field emission scanning electron microscope (FE-SEM). In addition, the density of the inclusion was determined. In the determination of the type of inclusion, the inclusion was considered to contain an element when the atomic fraction of the element relative to the chemical composition of the inclusion quantified by a ZAF method was 3% or more.

A tensile test was conducted in accordance with EN10002-1 using a round-bar tensile test specimen having a parallel portion with a diameter of 14 mm and a length of 70 mm, which was taken from the ¼-thickness (t) position of the plate so as to be parallel to the plate-width direction. Note that the yield strength (YS) shown in Table 2 refers to an upper yield stress in the case where the upper yield point was confirmed and a 0.2%-proof stress in the case where the upper yield point was not confirmed.

The welded joints used in CTOD testing of welded joints, which had a K-shaped bevel, were prepared by submerged arc welding (multipass welding) at a heat input of 5.0 kJ/mm. The test was conducted in accordance with the BS standard EN10225 (2009) using test specimens having a cross-sectional shape of t (plate thickness)×t (plate thickness) in order to determine CTOD value (δ) at a testing temperature of −40° C. For each steel type and each notch position, three test specimens were subjected to the test. A steel plate having an average CTOD value of 0.40 mm or more was considered to be a steel plate having good CTOD property of welded joints. The notch was formed in the CGHAZ in the vicinity of the K-shaped bevel (i.e., at a position 0.25 mm from the weld line toward the base metal) and at the SC/ICHAZ boundary (i.e., a position 0.25 mm from the corroded HAZ boundary, which was formed by etching the test specimen for CTOD testing of welded joints with nitric acid, toward the base metal). After the test was finished, it was confirmed that, in the fracture surface of the test specimen, the edges of the fatigue cracks reached the CGHAZ and the SC/ICHAZ boundary specified by EN10225 (2009). Note that, in CTOD testing of welded joints formed by multipass welding, both CGHAZ toughness and ICCGHAZ toughness reflect on the test results because a test specimen having a notch formed in the CGHAZ also includes a certain amount of the ICCGHAZ.

Table 2 summarizes the test results. Nos. 1 to 11, which are steel types that fall within the preferred scope of the present invention in terms of chemical composition, the average crystal grain size of the base metal, inclusion density, and production conditions, had good CTOD property of welded joints both in the case where a notch was formed in the CGHAZ and in the case where a notch was formed at the SC/ICHAZ boundary.

On the other hand, Nos. 12 to 26, which are Comparative Examples, had poor CTOD property of welded joints in the CGHAZ and/or at the SC/ICHAZ boundary.

In No. 12, where the C content was high, the HAZ microstructure became a hard microstructure having low toughness. As a result, the CTOD value of welded joints in the CGHAZ was low.

In No. 13, where the Ti content and Ti/N were low, the content of TiN, which is required for preventing coarsening of the HAZ microstructure, was low. As a result, the CTOD value of welded joints in the CGHAZ was low.

In No. 14, where Ti/N was high, coarse TiC particles were precipitated and dissolved Ti were present, which reduced the HAZ toughness. As a result, the CTOD values of welded joints in the CGHAZ and at the SC/ICHAZ boundary were low.

In No. 15, where Ceq was high, that is, out of the preferred range of the present invention, the HAZ microstructure was a hard microstructure having low toughness. As a result, the CTOD value of welded joints in the CGHAZ was low.

In No. 16, where the B content and Pcm were high, that is, out of the preferred range of the present invention, the HAZ microstructure was a hard microstructure having low toughness. As a result, the CTOD value of welded joints in the CGHAZ was low.

In No. 17, where ACR was low, the sulfide-based inclusion was mainly composed of MnS and the content of the Ca-based composite inclusion, which is necessary for the refinement of the HAZ microstructure, was low. As a result, the CTOD value of welded joints in the CGHAZ was low.

In No. 18, where ACR was high, the sulfide-based inclusion was mainly composed of CaS and the content of the Ca-based composite inclusion, which is necessary for the refinement of the HAZ microstructure, was low. As a result, the CTOD value of welded joints in the CGHAZ was low.

In No. 19, where the Ca content was low, the content of the Ca-based composite inclusion, which is necessary for the refinement of the HAZ microstructure, was low. As a result, the CTOD value of welded joints in the CGHAZ was low.

In No. 20, where the S content and the Ca content were high, the amount of inclusion was high. As a result, the CTOD values of welded joints in the CGHAZ and at the SC/ICHAZ boundary were low.

In No. 21, where the heating temperature was high, the average crystal grain size of the base metal was large due to the growth of crystal grains which occurred while heating to a high temperature was performed. As a result, the CTOD value of welded joints at the SC/ICHAZ boundary was low.

In No. 22, where the heating temperature was low, the cast microstructure remained and the average crystal grain size of the base metal was large. As a result, the CTOD value of welded joints at the SC/ICHAZ boundary was low.

In No. 23, where the amount of rolling reduction performed in the recrystallization region was small, the average crystal grain size of the base metal was large. As a result, the CTOD value of welded joints at the SC/ICHAZ boundary was low.

In No. 24, where the amount of rolling reduction performed in the non-recrystallization region was small, the average crystal grain size of the base metal was large. As a result, the CTOD value of welded joints at the SC/ICHAZ boundary was low.

In No. 25, where the cooling rate was low, coarse ferrite was formed and consequently the average crystal grain size of the base metal was large. As a result, the CTOD value of welded joints at the SC/ICHAZ boundary was low.

In No. 26, where the tempering temperature was high, coarse ferrite was formed and consequently the average crystal grain size of the base metal was large. As a result, the CTOD value of welded joints at the SC/ICHAZ boundary was low.

TABLE 1

| Steel type | C | Si | Mn | P | S | Al | Ni | Ti | N | O | Ca | Cu | Cr |
|---|---|---|---|---|---|---|---|---|---|---|---|---|---|
| A | 0.03 | 0.1 | 1.8 | 0.005 | 0.0015 | 0.027 | 1.5 | 0.008 | 0.0045 | 0.0012 | 0.0016 | | |
| B | 0.09 | 0.3 | 1.3 | 0.004 | 0.0017 | 0.031 | 0.9 | 0.022 | 0.0056 | 0.0026 | 0.0026 | | |
| C | 0.05 | 0.4 | 1.3 | 0.012 | 0.0023 | 0.013 | 1.8 | 0.016 | 0.0053 | 0.0036 | 0.0028 | | |
| D | 0.10 | 0.3 | 1.1 | 0.007 | 0.0006 | 0.036 | 0.6 | 0.005 | 0.0029 | 0.0048 | 0.0048 | 0.45 | |
| E | 0.06 | 0.2 | 1.6 | 0.006 | 0.0009 | 0.028 | 1.3 | 0.027 | 0.0064 | 0.0012 | 0.0007 | | |
| F | 0.09 | 0.5 | 1.2 | 0.003 | 0.0031 | 0.016 | 0.7 | 0.014 | 0.0041 | 0.0015 | 0.0046 | | |
| G | 0.04 | 0.2 | 2.0 | 0.008 | 0.0013 | 0.007 | 0.5 | 0.018 | 0.0048 | 0.0045 | 0.0041 | | |
| H | 0.07 | 0.2 | 1.5 | 0.005 | 0.0045 | 0.009 | 1.0 | 0.011 | 0.0033 | 0.0022 | 0.0036 | | 0.30 |
| I | 0.08 | 0.1 | 1.4 | 0.007 | 0.0014 | 0.052 | 0.9 | 0.018 | 0.0041 | 0.0031 | 0.0036 | | |
| J | 0.05 | 0.3 | 1.0 | 0.008 | 0.0009 | 0.026 | 1.2 | 0.019 | 0.0052 | 0.0026 | 0.0028 | | |
| K | 0.06 | 0.2 | 1.3 | 0.006 | 0.0026 | 0.019 | 0.8 | 0.009 | 0.0037 | 0.0019 | 0.0031 | | |
| L | 0.12 | 0.1 | 1.0 | 0.005 | 0.0011 | 0.021 | 0.6 | 0.021 | 0.0055 | 0.0016 | 0.0017 | | |
| M | 0.06 | 0.2 | 1.6 | 0.007 | 0.0015 | 0.031 | 1.0 | 0.002 | 0.0032 | 0.0035 | 0.0021 | | |
| N | 0.05 | 0.3 | 1.7 | 0.006 | 0.0013 | 0.026 | 0.8 | 0.019 | 0.0032 | 0.0032 | 0.0038 | 0.36 | |
| O | 0.07 | 0.4 | 1.7 | 0.008 | 0.0026 | 0.046 | 1.3 | 0.009 | 0.0029 | 0.0036 | 0.0024 | | 0.16 |
| P | 0.08 | 0.4 | 1.4 | 0.006 | 0.0018 | 0.018 | 1.2 | 0.019 | 0.0052 | 0.0026 | 0.0028 | | |
| Q | 0.09 | 0.2 | 1.6 | 0.006 | 0.0014 | 0.017 | 0.9 | 0.011 | 0.0043 | 0.0045 | 0.0022 | | |
| R | 0.10 | 0.2 | 1.5 | 0.004 | 0.0014 | 0.021 | 0.7 | 0.021 | 0.0055 | 0.0022 | 0.0045 | | |
| S | 0.07 | 0.1 | 1.6 | 0.008 | 0.0006 | 0.019 | 1.1 | 0.008 | 0.0028 | 0.0011 | 0.0004 | 0.13 | |
| T | 0.08 | 0.2 | 1.5 | 0.007 | 0.0071 | 0.054 | 0.9 | 0.018 | 0.0051 | 0.0049 | 0.0118 | | 0.25 |

(mass %)

| Steel type | Mo | Nb | V | W | B | REM | Mg | Ti/N | Ceq (%) | Pcm (%) | ACR | Category |
|---|---|---|---|---|---|---|---|---|---|---|---|---|
| A | | | | | | | | 1.8 | 0.43 | 0.15 | 0.6 | Invention example |
| B | | 0.028 | | | | | | 3.9 | 0.37 | 0.18 | 0.6 | Invention example |
| C | | | | | | | | 3.0 | 0.39 | 0.16 | 0.3 | Invention example |
| D | | | | | | | | 1.7 | 0.35 | 0.20 | 1.3 | Invention example |
| E | 0.13 | | | | | | | 4.2 | 0.44 | 0.18 | 0.3 | Invention example |
| F | | | 0.03 | | | | | 3.4 | 0.34 | 0.18 | 0.9 | Invention example |
| G | | | | 0.23 | | | | 3.8 | 0.41 | 0.16 | 0.5 | Invention example |
| H | | | | | | | | 3.3 | 0.45 | 0.18 | 0.4 | Invention example |
| I | | | | | 0.0016 | | | 4.4 | 0.37 | 0.18 | 0.9 | Invention example |
| J | | | | | | 0.0081 | | 3.7 | 0.30 | 0.13 | 1.2 | Invention example |
| K | | | | | | | 0.0015 | 2.4 | 0.33 | 0.15 | 0.6 | Invention example |
| L | | | | | | | | 3.8 | 0.33 | 0.18 | 0.8 | Comparative example |
| M | | | | | | | | 0.6 | 0.39 | 0.16 | 0.3 | Comparative example |
| N | | | | | | | | 5.9 | 0.41 | 0.18 | 1.0 | Comparative example |
| O | | | | | | | | 3.1 | 0.47 | 0.20 | 0.2 | Comparative example |
| P | 0.25 | | 0.04 | | 0.0023 | | | 3.7 | 0.45 | 0.22 | 0.6 | Comparative example |
| Q | | | | | | | | 2.6 | 0.42 | 0.19 | 0.1 | Comparative example |
| R | 0.07 | | | | | | | 3.8 | 0.41 | 0.20 | 1.6 | Comparative example |
| S | | 0.008 | | | | | | 2.9 | 0.42 | 0.18 | 0.2 | Comparative example |
| T | | 0.013 | | | | | | 3.5 | 0.44 | 0.19 | 0.4 | Comparative example |

Note 1:

Underlined portions are out of the scope of the present invention.

Note 2:

Ceq = [C] + [Mn]/6 + ([Cu] + [Ni])/15 + ([Cr] + [Mo] + [V])/5, Pcm = [C] + [Si]/30 + ([Mn] + [Cu] + [Cr])/20 + [Ni]/60 + [Mo]/15 + [V]/10 + 5[B] ACR = (Ca − (0.18 + 130 × Ca) × O)/(1.25 × S), where alloy element symbols represent the contents (mass %) of the respective elements.

TABLE 2

| No. | Steel type | Thickness (mm) | Heating temperature (° C.) | Cumulative rolling reduction ratio of passes performed at rolling reduction ratio per pass of 8% or more at 950° C. or more (%) | Cumulative rolling reduction ratio of passes performed at rolling reduction ratio per pass of 5% or more at 950° C. or more (%) | Cumulative rolling reduction ratio of passes performed at less than 950° C. (%) | Average cooling rate between 700° C. and 500° C. (° C./sec) | Tempering temperature (° C.) | Effective crystal grain size (μm) |
|---|---|---|---|---|---|---|---|---|---|
| 1 | A | 50 | 1050 | 45 | 51 | 60 | 12 | — | 11 |
| 2 | B | 90 | 1030 | 55 | 55 | 53 | 6 | 660 | 9 |
| 3 | C | 102 | 1190 | 43 | 43 | 67 | 2 | — | 18 |
| 4 | D | 35 | 1120 | 39 | 39 | 58 | 21 | — | 7 |
| 5 | E | 25 | 970 | 31 | 36 | 63 | 46 | 580 | 13 |
| 6 | F | 40 | 1070 | 50 | 50 | 66 | 16 | 610 | 10 |
| 7 | G | 40 | 1150 | 37 | 42 | 42 | 18 | 550 | 19 |
| 8 | H | 90 | 1000 | 40 | 46 | 49 | 5 | — | 10 |
| 9 | I | 51 | 990 | 50 | 60 | 50 | 9 | 520 | 9 |
| 10 | J | 51 | 960 | 35 | 35 | 52 | 10 | — | 14 |
| 11 | K | 102 | 1100 | 46 | 46 | 50 | 3 | — | 12 |
| 12 | L | 90 | 1030 | 40 | 40 | 45 | 5 | — | 16 |
| 13 | M | 45 | 1080 | 38 | 44 | 50 | 13 | — | 20 |
| 14 | N | 76 | 1050 | 40 | 40 | 46 | 7 | — | 12 |
| 15 | O | 52 | 1180 | 35 | 35 | 53 | 10 | 610 | 13 |
| 16 | P | 33 | 1060 | 40 | 46 | 67 | 25 | 580 | 17 |
| 17 | Q | 90 | 1060 | 56 | 61 | 46 | 6 | — | 18 |
| 18 | R | 102 | 1070 | 42 | 42 | 54 | 3 | 550 | 12 |
| 19 | S | 51 | 1030 | 41 | 41 | 50 | 11 | 600 | 9 |
| 20 | T | 50 | 1050 | 45 | 50 | 53 | 13 | 610 | 11 |
| 21 | A | 63 | 1230 | 38 | 43 | 56 | 9 | — | 28 |
| 22 | D | 45 | 920 | 39 | 39 | 55 | 18 | — | 31 |
| 23 | F | 48 | 1070 | 26 | 26 | 57 | 14 | 610 | 29 |
| 24 | I | 90 | 1000 | 50 | 50 | 36 | 6 | 540 | 38 |
| 25 | J | 102 | 980 | 40 | 40 | 65 | 0.7 | — | 40 |
| 26 | C | 90 | 1180 | 45 | 51 | 60 | 5 | 760 | 19 |

| No. | Steel type | Density of Ca-based composite inclusion at ¼ · t (particle/mm$^2$) | Density of Ca-based composite inclusion at ½ · t (particle/mm$^2$) | YS of base metal at ¼ · t (Mpa) | Number of weld passes | δ of CGHAZ (mm) | δ of SC/ICHAZ boundary (mm) | Category |
|---|---|---|---|---|---|---|---|---|
| 1 | A | 38 | 40 | 459 | 24 | 2.34 | 2.67 | Invention example |
| 2 | B | 71 | 68 | 417 | 50 | 1.78 | 2.11 | Invention example |
| 3 | C | 73 | 70 | 363 | 53 | 0.79 | 1.23 | Invention example |
| 4 | D | 56 | 52 | 433 | 17 | 0.62 | 1.18 | Invention example |
| 5 | E | 31 | 29 | 487 | 15 | 0.84 | 0.79 | Invention example |
| 6 | F | 168 | 150 | 415 | 19 | 1.36 | 2.03 | Invention example |
| 7 | G | 100 | 108 | 455 | 19 | 2.28 | 1.36 | Invention example |
| 8 | H | 83 | 77 | 407 | 47 | 0.64 | 2.18 | Invention example |
| 9 | I | 58 | 50 | 426 | 25 | 1.76 | 2.31 | Invention example |
| 10 | J | 46 | 50 | 376 | 27 | 2.56 | 2.27 | Invention example |
| 11 | K | 93 | 90 | 360 | 55 | 2.89 | 2.85 | Invention example |
| 12 | L | 36 | 30 | 372 | 51 | 0.16 | 0.78 | Comparative example |
| 13 | M | 63 | 53 | 443 | 22 | 0.19 | 1.54 | Comparative example |
| 14 | N | 85 | 70 | 410 | 44 | 0.29 | 0.31 | Comparative example |
| 15 | O | 66 | 61 | 436 | 27 | 0.08 | 0.67 | Comparative example |
| 16 | P | 58 | 55 | 556 | 17 | 0.11 | 0.81 | Comparative example |
| 17 | Q | 12 | 16 | 389 | 51 | 0.18 | 0.79 | Comparative example |
| 18 | R | 9 | 12 | 361 | 52 | 0.22 | 0.65 | Comparative example |
| 19 | S | 9 | 15 | 468 | 27 | 0.16 | 1.56 | Comparative example |
| 20 | T | 268 | 280 | 470 | 25 | 0.35 | 0.32 | Comparative example |
| 21 | A | 53 | 44 | 446 | 36 | 2.16 | 0.36 | Comparative example |
| 22 | D | 52 | 47 | 428 | 22 | 0.54 | 0.29 | Comparative example |
| 23 | F | 185 | 170 | 405 | 24 | 1.28 | 0.28 | Comparative example |
| 24 | I | 67 | 61 | 385 | 50 | 1.13 | 0.18 | Comparative example |
| 25 | J | 40 | 35 | 303 | 51 | 2.28 | 0.27 | Comparative example |
| 26 | C | 63 | 69 | 335 | 50 | 0.69 | 0.34 | Comparative example |

Note 1:
Underlined portions are out of the scope of the present invention.
Note 2:
t represents plate thickness (mm)

The invention claimed is:

1. A thick steel plate with which a multipass welded joint having good CTOD property is formed, the thick steel plate comprising a composition containing, by mass, C: 0.03% to 0.10%, Si: 0.5% or less, Mn: 1.0% to 2.0%, P: 0.015% or less, S: 0.0005% to 0.0050%, Al: 0.005% to 0.060%, Ni: 0.5% to 2.0%, Ti: 0.005% to 0.030%, N: 0.0015% to 0.0065%, O: 0.0010% to 0.0050%, and Ca: 0.0005% to 0.0060%, with the balance being Fe and inevitable impurities, wherein the composition satisfies Expressions (1) to (4), wherein an effective crystal grain size of a base metal at the center of the thick steel plate in a thickness direction is 20 μm or less, wherein the densities of a composite inclusion at a ¼-position and a ½-position of the thick steel plate in a thickness direction where thickness is in millimeters, the composite inclusion including a sulfide containing Ca and Mn and an oxide containing Al, the composite inclusion having an equivalent circular diameter of 0.1 μm or more, are each 25 to 250 particle/mm$^2$, $$1.5 \leq Ti/N \leq 5.0 \quad \text{Expression (1):}$$

$$Ceq(=[C]+[Mn]/6+([Cu]+[Ni])/15+([Cr]+[Mo]+[V])/5) \leq 0.45 \quad \text{Expression (2):}$$

$$Pcm(=[C]+[Si]/30+([Mn]+[Cu]+[Cr])/20+[Ni]/60+[Mo]/15+[V]/10+5[B]) \leq 0.20 \quad \text{Expression (3):}$$

$$0.2 < (Ca-(0.18+130 \times Ca) \times O)/(1.25 \times S) < 1.4 \quad \text{Expression (4):}$$

and wherein, in Expressions (1) to (4), alloy element symbols represent the contents (mass %) of the respective elements.

2. The thick steel plate according to claim 1 with which a multipass welded joint having good CTOD property is formed, wherein the composition of the thick steel plate further contains one or more elements selected from, by mass, Cu: 0.05% to 2.0%, Cr: 0.05% to 0.30%, Mo: 0.05% to 0.30%, Nb: 0.005% to 0.035%, V: 0.01% to 0.10%, W: 0.01% to 0.50%, B: 0.0005% to 0.0020%, REM: 0.0020% to 0.0200%, and Mg: 0.0002% to 0.0060%.

3. A method for producing the thick steel plate according to claim 1 with which a multipass welded joint having good CTOD property is formed, the method comprising: heating a steel slab to a range of from 950° C. to 1200° C., the steel slab having the composition according to claim 1; performing hot rolling such that a cumulative rolling reduction ratio of passes performed at a rolling reduction ratio per pass of 8% or more while the temperature of the center of the thick steel plate in a thickness direction is 950° C. or more is 30% or more and performing hot rolling such that a cumulative rolling reduction ratio of passes performed while the temperature of the center of the thick steel plate in a thickness direction is less than 950° C. is 40% or more; and performing cooling to 600° C. or less such that an average cooling rate between 700° C. and 500° C. at the center of the thick steel plate in a thickness direction is 1° C./sec to 50° C./sec.

4. A method for producing the thick steel plate according to claim 1 with which a multipass welded joint having good CTOD property is formed, the method comprising: heating a steel slab to a range of from 950° C. to 1200° C., the steel slab having the composition according to claim 1; performing hot rolling such that a cumulative rolling reduction ratio of passes performed at a rolling reduction ratio per pass of 5% or more while the temperature of the center of the thick steel plate in a thickness direction is 950° C. or more is 35% or more and performing hot rolling such that a cumulative rolling reduction ratio of passes performed while the temperature of the center of the thick steel plate in a thickness direction is less than 950° C. is 40% or more; and performing cooling to 600° C. or less such that an average cooling rate between 700° C. and 500° C. at the center of the thick steel plate in a thickness direction is 1° C./sec to 50° C./sec.

5. The method according to claim 3 for producing a thick steel plate with which a multipass welded joint having good CTOD property is formed, the method further comprising performing a tempering treatment at 700° C. or less subsequent to cooling.

6. A method for producing the thick steel plate according to claim 2 with which a multipass welded joint having good CTOD property is formed, the method comprising: heating a steel slab to a range of from 950° C. to 1200° C., the steel slab having the composition according to claim 2; performing hot rolling such that a cumulative rolling reduction ratio of passes performed at a rolling reduction ratio per pass of 8% or more while the temperature of the center of the thick steel plate in a thickness direction is 950° C. or more is 30% or more and performing hot rolling such that a cumulative rolling reduction ratio of passes performed while the temperature of the center of the thick steel plate in a thickness direction is less than 950° C. is 40% or more; and performing cooling to 600° C. or less such that an average cooling rate between 700° C. and 500° C. at the center of the thick steel plate in a thickness direction is 1° C./sec to 50° C./sec.

7. A method for producing the thick steel plate according to claim 2 with which a multipass welded joint having good CTOD property is formed, the method comprising: heating a steel slab to a range of from 950° C. to 1200° C., the steel slab having the composition according to claim 2; performing hot rolling such that a cumulative rolling reduction ratio of passes performed at a rolling reduction ratio per pass of 5% or more while the temperature of the center of the thick steel plate in a thickness direction is 950° C. or more is 35% or more and performing hot rolling such that a cumulative rolling reduction ratio of passes performed while the temperature of the center of the thick steel plate in a thickness direction is less than 950° C. is 40% or more; and performing cooling to 600° C. or less such that an average cooling rate between 700° C. and 500° C. at the center of the thick steel plate in a thickness direction is 1° C./sec to 50° C./sec.

8. The method according to claim 4 for producing a thick steel plate with which a multipass welded joint having good CTOD property is formed, the method further comprising performing a tempering treatment at 700° C. or less subsequent to cooling.

* * * * *